US007182623B1

(12) United States Patent
Lewis

(10) Patent No.: US 7,182,623 B1
(45) Date of Patent: Feb. 27, 2007

(54) LEVER-AND-SPRING ASSEMBLY FOR AN ELECTRONICS MODULE

(75) Inventor: Jeffrey M. Lewis, Maynard, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 11/324,970

(22) Filed: Jan. 3, 2006

(51) Int. Cl.
*H01R 13/627* (2006.01)

(52) U.S. Cl. ..... 439/352; 439/160; 439/298; 439/328

(58) Field of Classification Search ..... 439/352, 439/160, 298, 328
See application file for complete search history.

(56) References Cited

U.S. PATENT DOCUMENTS 5,234,354 A * 8/1993 Smart ..... 439/326
5,938,463 A * 8/1999 Yodogawa ..... 439/326

* cited by examiner

*Primary Examiner*—Truc Nguyen
(74) *Attorney, Agent, or Firm*—Guerin & Rodriguez, LLP; Michael A. Rodriguez

(57) ABSTRACT

Described is a lever-and-spring assembly for an electronic module. The electronic module has a flange extending from one of its sides. The lever-and-spring assembly has a lever coupled to the flange at a pivot point about which the lever-and-spring assembly can pivot. The lever-and-spring assembly also has a leaf spring with a base portion and a spring portion extending from an edge of the base portion and bending back over the base portion. The lever is disposed between the base portion and the spring portion. The base portion is affixed to the lever. The spring portion bends back over the lever. The flange slides closely between the spring portion and the lever when the lever-and-spring assembly pivots towards a closed position.

16 Claims, 14 Drawing Sheets

LEVER-AND-SPRING ASSEMBLY FOR AN ELECTRONICS MODULE

RELATED APPLICATION

This patent application may be related to the following commonly owned co-pending United States patent application: "RAID Data Storage System with SAS Expansion," by Bailey et al., application Ser. No. 11/238,601, filed on Sep. 29, 2005, the entirety of which application is incorporated by reference herein.

FIELD OF THE INVENTION

The invention relates generally to rack-mountable enclosures and the installation of sub-assemblies or electronics modules within the enclosures. More particularly, the invention relates to an apparatus for inserting an electronic module into an enclosure, for securing the electronics module to the enclosure, and for extracting the electronics module from the enclosure.

BACKGROUND

Computer systems and data servers often require large-capacity data storage systems. These data storage systems typically include a plurality of enclosures, such as disk-processor enclosures (DPE) and disk-array enclosures (DAE). Housed within these enclosures are various types of subassemblies or electronics modules. For example, a typical disk-processor enclosure, configured for redundancy, has two storage processor boards, two power supplies, and, optionally, a plurality of disk-drive modules and two link control cards. A typical disk-array enclosure, configured for redundancy, includes a plurality of disk-drive modules, two link control cards, and two power supplies. The disk-drive modules in these enclosures cooperate according to a desired data storage application, e.g., JBOD (Just a Bunch of Disks), RAID (Redundant Array of Independent Disks), and SAN (Storage Area Network).

The construction of a data storage system generally involves mounting multiple enclosures within one or more racks. To make efficient use of the useable vertical space within a rack, the enclosures and various electronics modules housed within them have constraints on their physical dimensions. Accordingly, many electronics modules, such as power supplies, have relatively small vertical dimensions, i.e., 1U and 2U.

These physical constraints have produced crowded front panels for small electronics modules; crowded, for example, with air vents, handles, and sockets for electrical plugs. Normally, an electronics module would also have latching mechanisms on their front panels for securing the module to the enclosure. By being located on the front panel, the latching mechanism simplified the installation and removal of the electronics module. With less space now available on some front panels, however, continued use of such latching mechanisms would require the loss of other potentially crucial features, e.g., the air vents.

SUMMARY

In one aspect, the invention features an electronics module comprising a housing with a plurality of sides, a flange extending from an edge of one of the sides of the box, and a lever-and-spring assembly having a lever and a leaf spring. The lever is coupled to the flange at a pivot point about which the lever-and-spring assembly can pivot. The leaf spring has a base portion and a spring portion extending from an edge of the base portion and bending back over the base portion. The lever is disposed between the base portion and the spring portion. The base portion is affixed to the lever. The spring portion bends back over the lever to form a slot therebetween. The flange slides into the slot between the spring portion and the lever when the lever-and-spring assembly pivots towards a closed position.

In another aspect, the invention features an electronics rack, comprising a chassis mounted to the rack, and an electronics module installed in the chassis. The electronics module comprises a housing with a plurality of sides, a flange extending from an edge of one of the sides of the box, and a lever-and-spring assembly having a lever coupled to the flange at a pivot point about which the lever-and-spring assembly can pivot. The lever-and-spring assembly also has a leaf spring with a base portion and a spring portion extending from an edge of the base portion and bending back over the base portion. The lever is disposed between the base portion and the spring portion. The base portion is affixed to the lever. The spring portion bends back over the lever to form a slot therebetween. The flange slides into the slot between the spring portion and the lever when the lever-and-spring assembly pivots towards a closed position.

In still another aspect, the invention features an apparatus comprising a leaf spring and a lever. The leaf spring has a base portion and a spring portion extending from an edge of the base portion and bending back over the base portion. The lever has opposite ends and a pivot point at one of the ends. The lever is disposed between the base portion and the spring portion of the leaf spring. The lever is affixed to the base portion. The spring portion bends back over the lever to form a slot therebetween.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Electronics modules embodying the invention have an integrated lever-and-spring assembly for inserting an electronics module into an enclosure chassis, for securing the electronics module to the chassis, and for extracting the electronics module from the chassis. Disposed at an edge of the electronics module, the lever-and-spring assembly occupies relatively little vertical space because of its thin construction. This location at the edge leaves much of the front panel of the electronics module available for implementing other features, such as air vents and handles. Accordingly, the invention is particularly advantageous for use with chassis and electronics modules having small vertical dimensions, and little or no space to spare on the front panel for a latching mechanism. Suited particularly for chassis and electronics modules that occupy racks in stacked configurations, the placement of the lever-and-spring assembly does not interfere with the visibility of or access to the front panel above or the front panel below.

Figure 1:
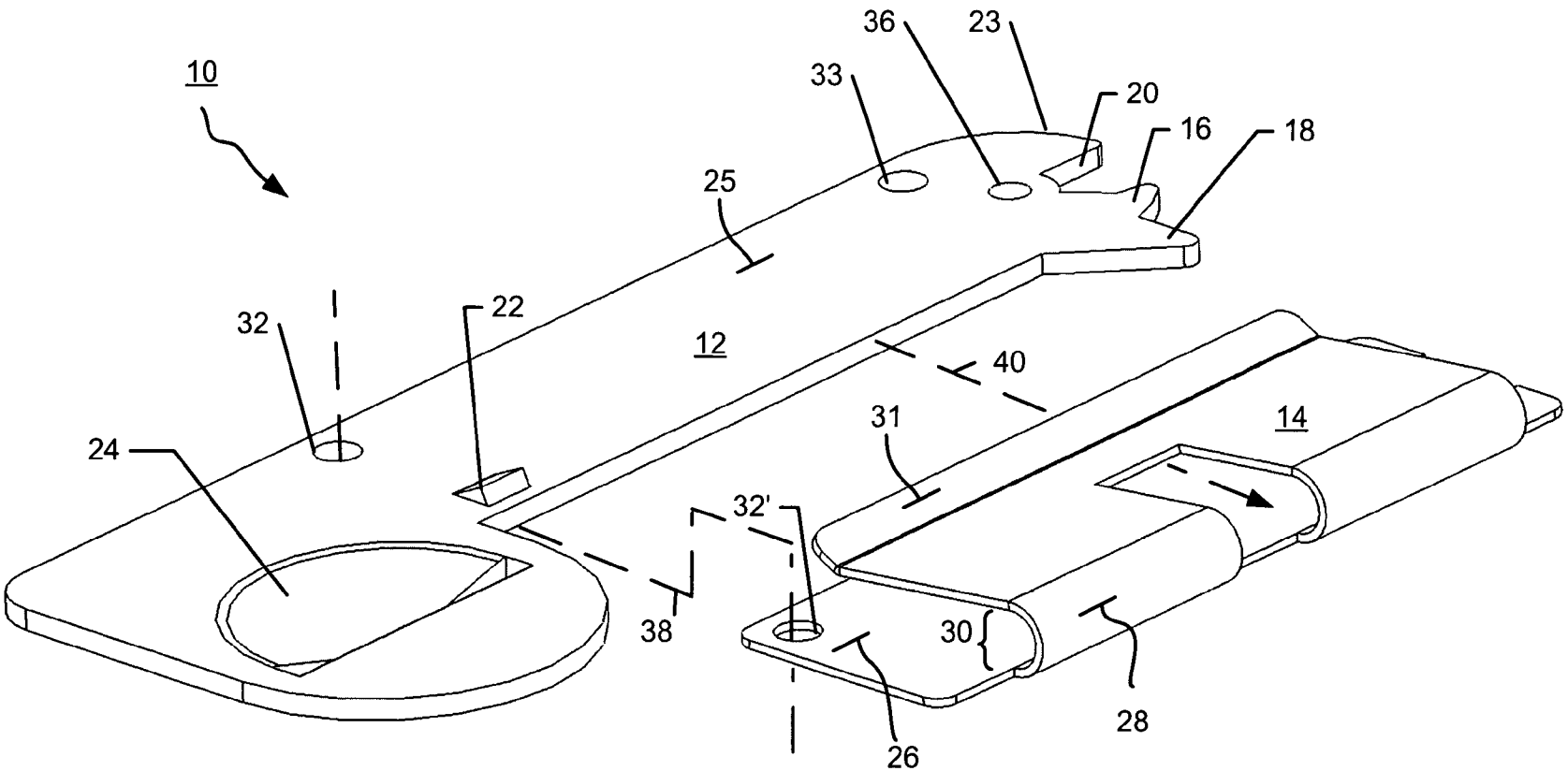
FIG. 1 is an exploded view of an embodiment of a lever-and-spring assembly embodying the invention.

FIG. 1 shows an exploded view of an embodiment of a lever-and-spring assembly 10 comprising a lever 12 and a leaf spring 14. Each piece (i.e., lever 12 and leaf spring 14) is a separate integral component, preferably constructed of sheet metal, although the lever-and-spring assembly 10 can be constructed of other types of material, such as plastic. The lever 12 is elongate, planar, and thin (e.g., 1 mm). At one end of the lever 12 are an extraction prong 16, a stop prong 18, and an insertion prong 20 with an arcuate edge 23. The lever 12 has a topside surface 25 with a raised catch 22 and a fingertip-sized semi-circular dimple 24 formed therein. The dimple 24 sits within a round, wider end of the lever 12. The lever 12 includes a plurality of openings 32, 33, 36 for receiving fasteners. The opening 36 aligns with the pivot point of the lever-and-spring assembly 10, as described below.

The leaf spring 14 has a base portion 26 and a spring portion 28 that bends back over the base portion 26 to form a sleeve 30 therebetween. The spring portion 28 has a raised edge portion 31 along a width thereof. The base portion 26 has an opening 32', which aligns with the opening 32 of the lever 12, as indicated by arrow 38, when the lever 12 and leaf spring 14 are connected to each other. (The base portion 26 has another opening—not seen because of the spring portion 28—which aligns with the opening 33 of the lever 12). The lever 12 fits into the sleeve 30 of the leaf spring 14 as indicated by the arrow 40.

Figure 2:
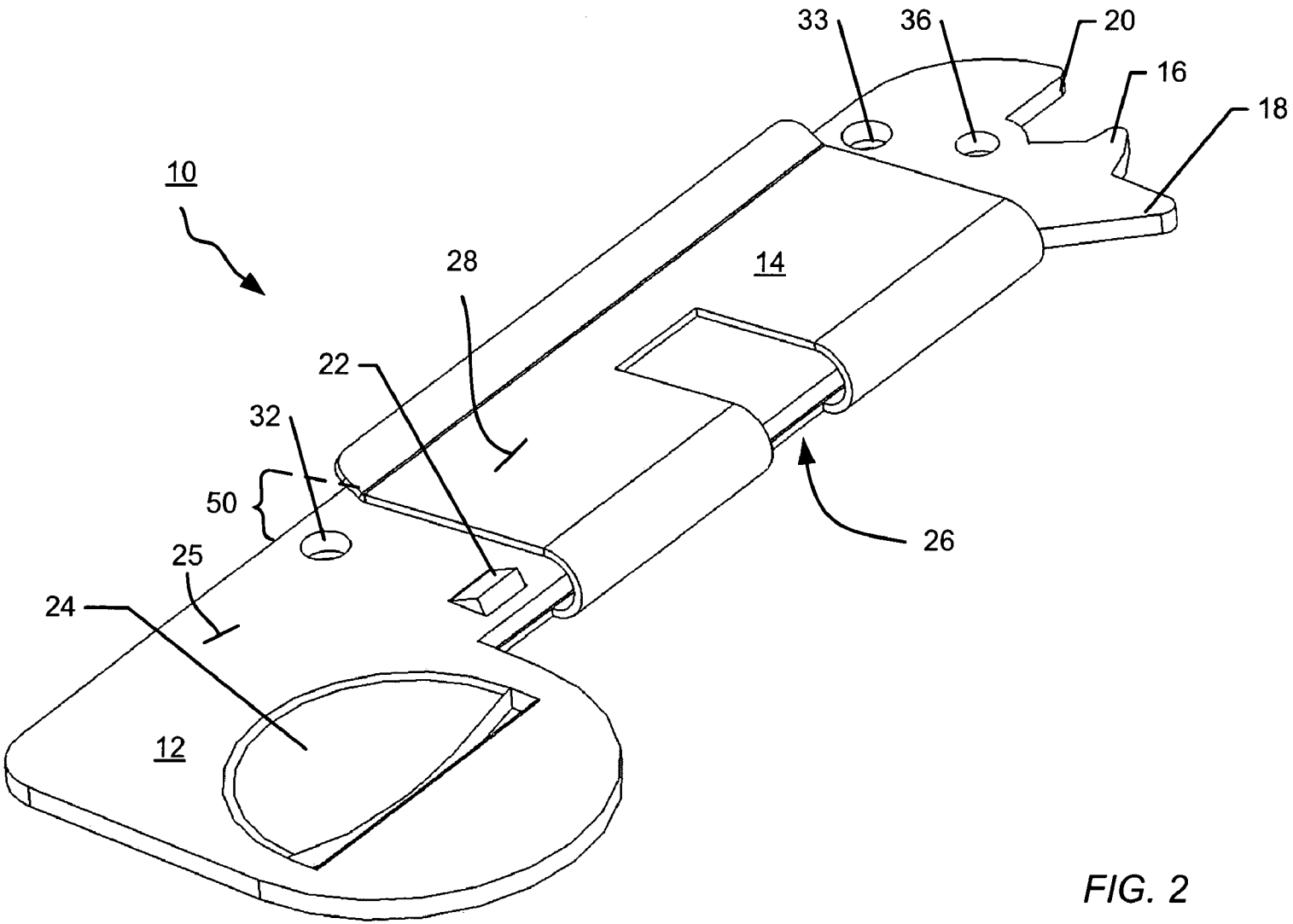
FIG. 2 is an elevated top view of the lever-and-spring assembly of FIG. 1.

FIG. 2 shows a top view of an assembled lever-and-spring assembly 10. Disposed laterally between the base portion 26 and the spring portion 28 of the leaf spring 14 is the lever 12. The lever 12 projects out of both sides of the leaf spring 14, the semi-circular dimple 24 from one side, and the prongs 16, 18, 20 from the other side. In one embodiment, the catch 22 remains uncovered by the spring portion 28. Fasteners (not shown) pass through holes 32, 33 to secure the lever 12 to the base portion 26 of the leaf spring 14. Examples of fasteners for providing this function include weld spots, rivets, nuts and bolts, and screws. The top surface 25 of the lever 12 and the underside of the spring portion 28 form a thin slot 50 therebetween.

Figure 3:
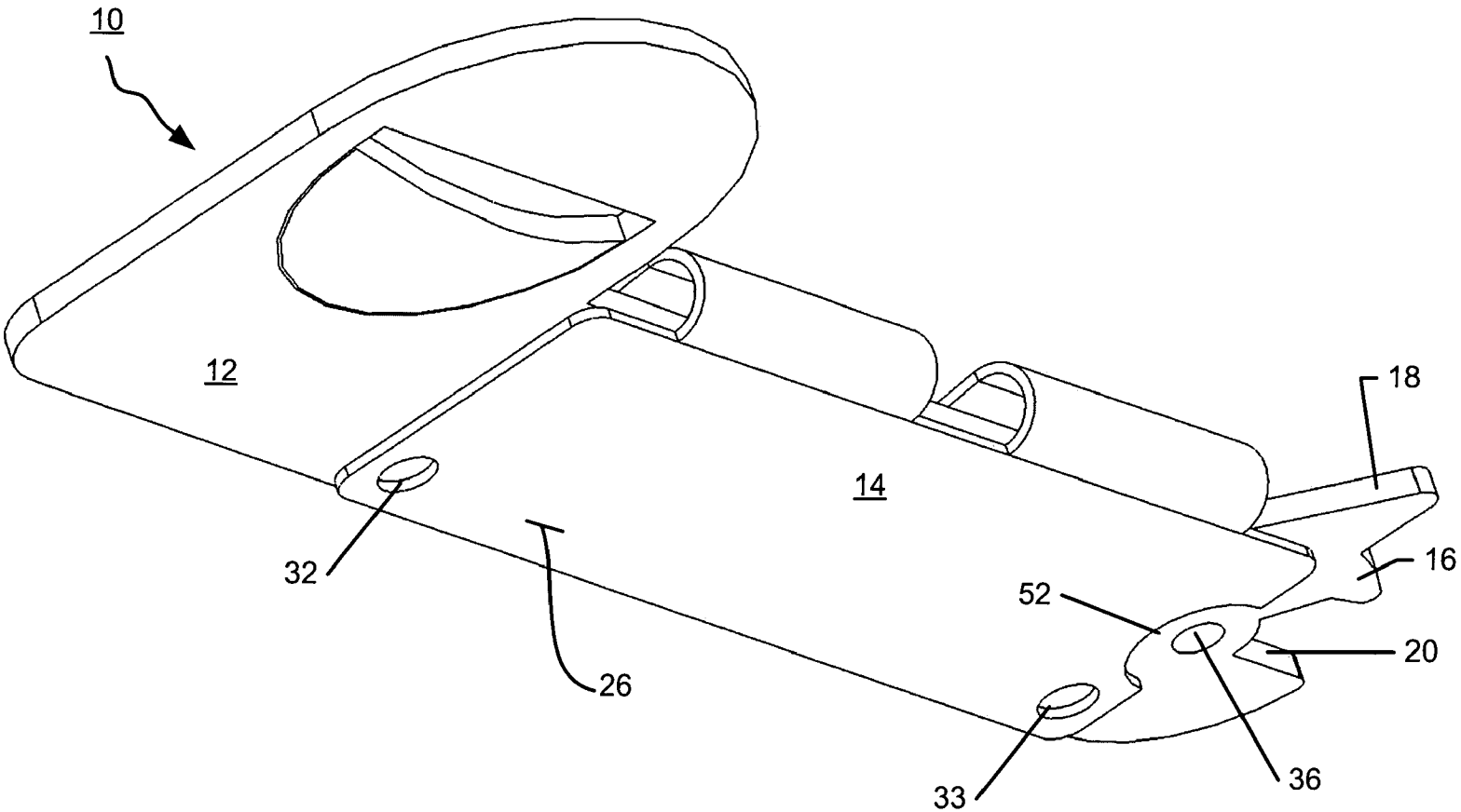
FIG. 3 is a bottom view of the lever-and-spring assembly of FIG. 1.

FIG. 3 shows a bottom view of the lever-and-spring assembly 10. The base portion 26 of the leaf spring 14 includes holes 32', 33' that correspond to and align with the similarly numbered holes 32, 33 of the lever 12. The base portion 26 is planar and generally rectangular with an arcuate cutout 52 at one end. The pivot point 36 lies partially within a circular region bounded on one side by the arcuate cutout 52.

Figure 4:
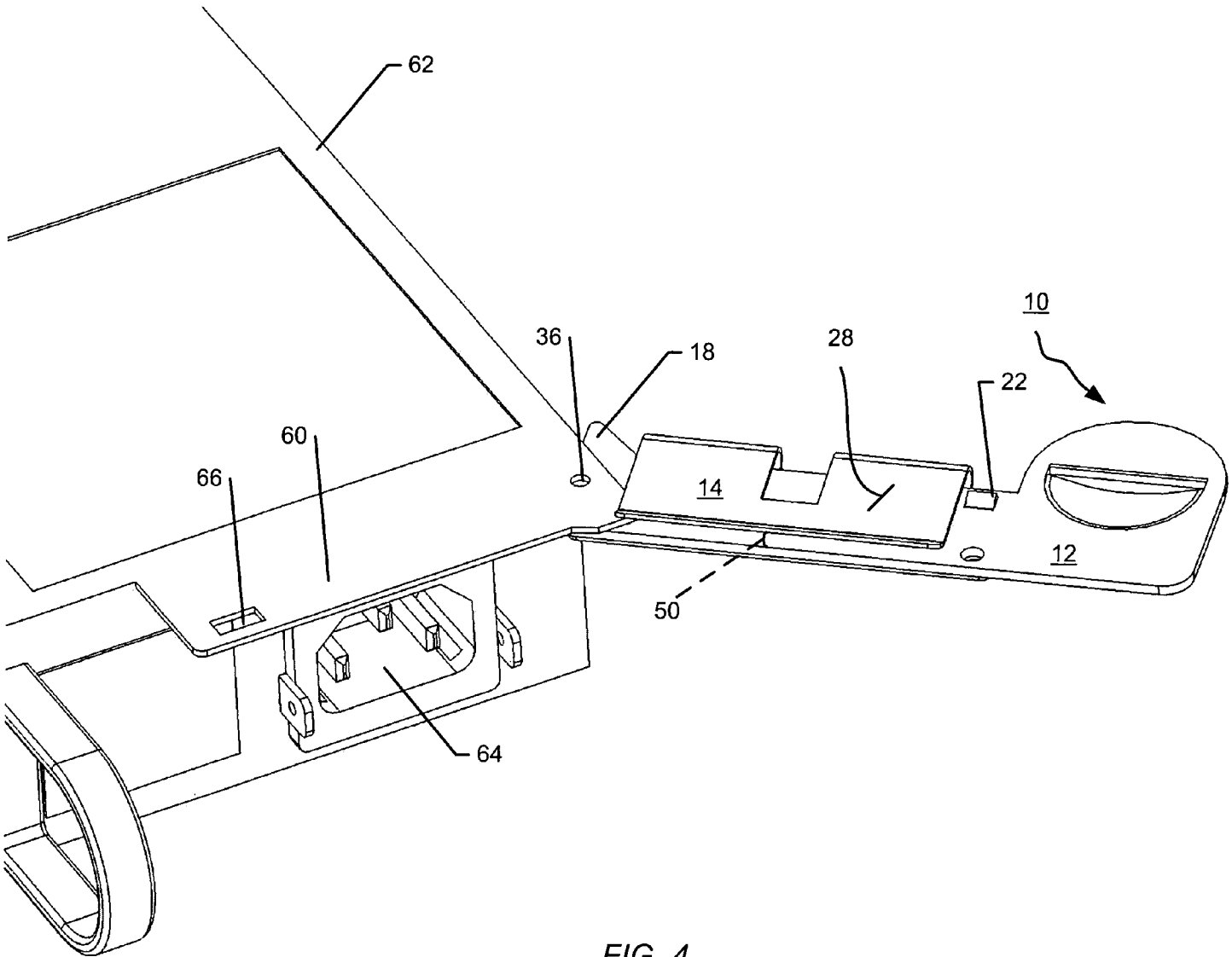
FIG. 4 is an elevated view of the lever-and-spring assembly attached to a flange of an electronics module.

FIG. 4 shows the lever-and-spring assembly 10 attached to a flange 60 of an electronics module 62 at the pivot point 36. In general, the flange 60 is planar and thin (e.g., 1 mm), and extends from an edge of the electronics module 62. Here, as an illustrative example, the electronics module 62 is a 1U power supply and the flange 60 overhangs an IC socket 64. The relative thinness and location of the lever-and-spring assembly 10 permits its use in tight quarters. Near the pivot point 36, the forward edge of the flange 60 extends farther away from the electronics module 62 than from other points along the forward edge. This additional projection ensures that a portion of the flange 60 remains pinched between the spring portion 28 and lever 12 for all possible pivot positions of the lever-and-spring assembly 10.

In general, the thickness of the flange 60 is slightly larger than the mouth of the slot 50. Accordingly, the flange 60 squeezes into the slot 50, deflecting the spring portion 28 away from the lever 12, and in effect, widening the slot 50 to receive the flange 60 closely therein. The deflected spring portion 28 thus exerts a force against that portion of the flange 60 situated between the spring portion 28 and the lever 12.

The flange 60 has a detent 66 for receiving and latching the catch 22 on the surface 25 of the lever 12 when the lever-and-spring assembly 10 pivots into a closed position, described below.

As shown in FIG. 4, the flange 60 extends from the top edge on the right-hand side of the electronics module 62, and the pivot point 36 is located near the upper right-hand corner of the electronics module 62. Being attached to the flange 60 at the pivot point 36, the lever-and-spring assembly 10 pivots clockwise towards the flange 60. In an alternative configuration, in which the flange extends from the left-hand side of the top edge and the pivot point is near the upper left-hand corner of the electronics module, the lever-and-spring assembly 10 pivots counterclockwise towards the flange. In still other embodiments, the flange can extend from a bottom edge or along a vertical side edge of the electronics module, with the lever-and-spring assembly pivoting clockwise, counterclockwise, upwards or downwards, depending upon the particular locations of the flange, pivot point, and lever-and-spring assembly on the electronics module.

Figure 5:
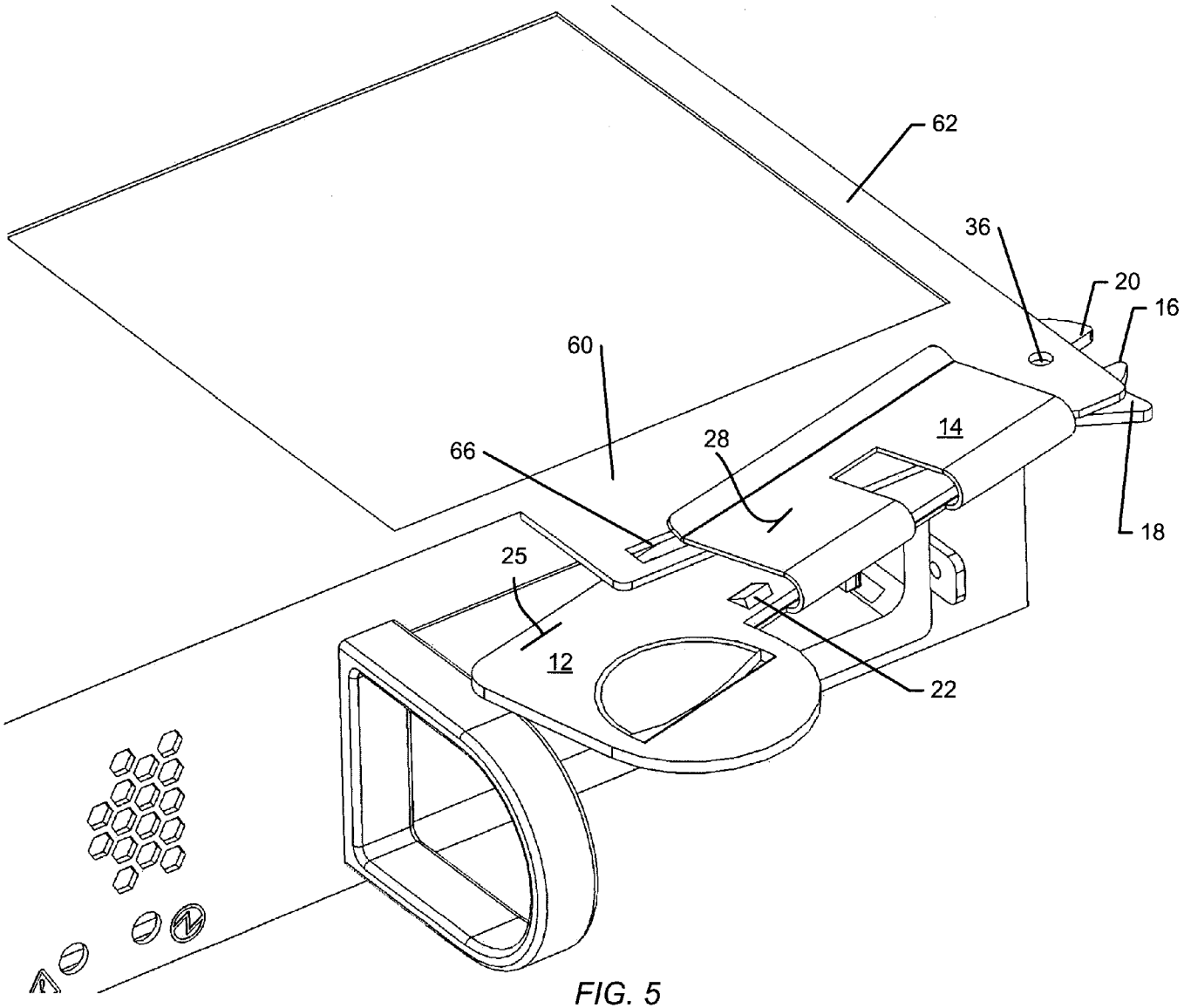
FIG. 5 is an elevated view of the lever-and-spring assembly in a partially closed position on the flange of the electronics module.
Figure 6:
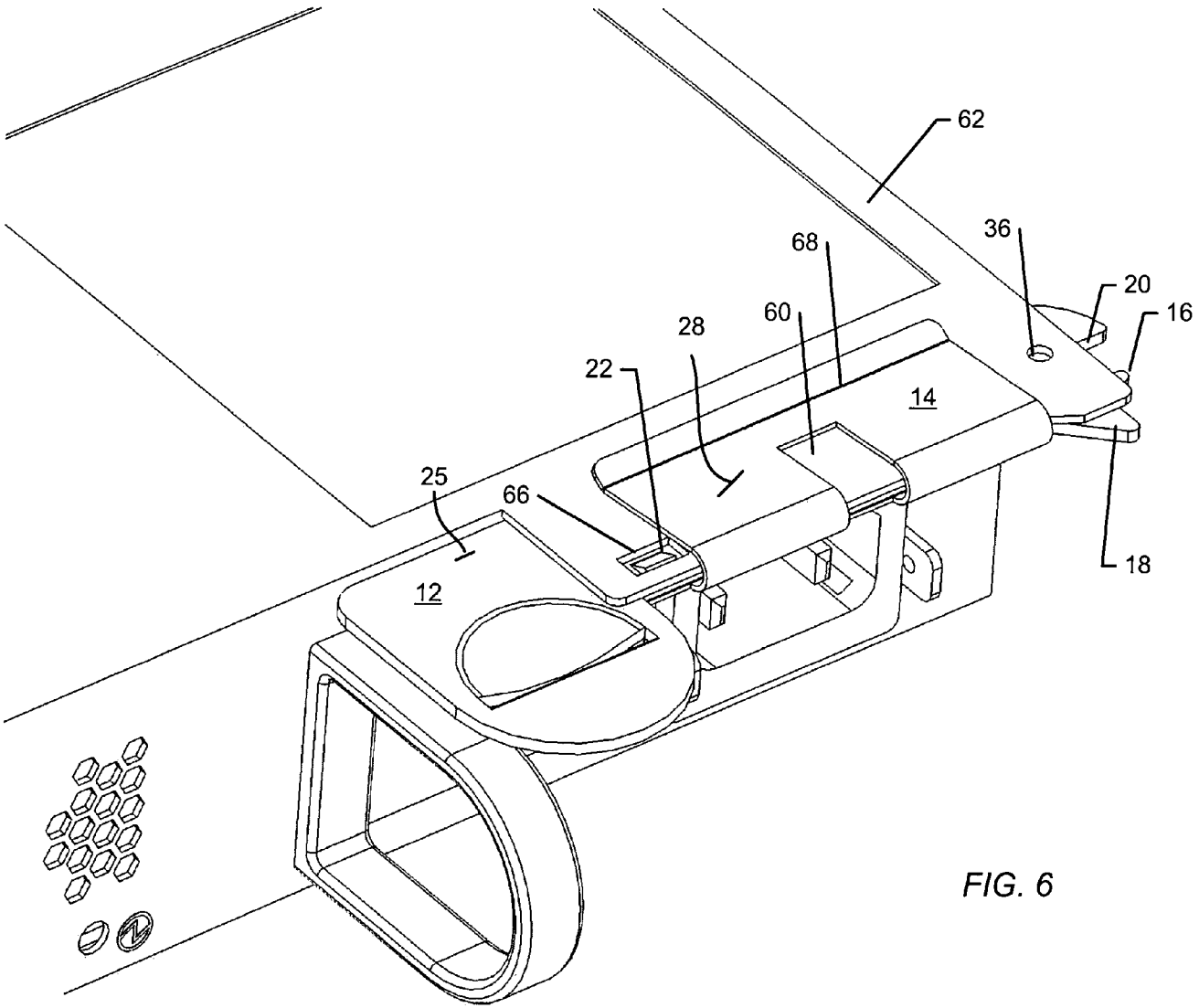
FIG. 6 is an elevated view of the lever-and-spring assembly in a closed position on the flange of the electronics module.

FIG. 5 shows the lever-and-spring assembly 10 in a partially closed position on the flange 60 of the electronics module 62, after being further rotated clockwise from the open position shown in FIG. 4. FIG. 6 shows the lever-and-spring assembly 10 pivoted fully into a closed position. In the closed position, the catch 22 on the surface 25 of the lever 12 sits within the detent 66 on the flange 60. As the lever-and-spring assembly 10 pivots toward the closed position, a sloped surface of the catch 22 deflects the lever 12 away from the flange 60. The lever 12 snaps back towards the flange 60 when the catch 22 fully enters the detent 66. A leading edge 68 on the underside of the spring portion 28 urges the flange 60 against the lever 12 with sufficient force to keep the catch 22 within the detent 66. A back edge of the catch 22 also assists in keeping the catch 22 from laterally backing out of the detent 66.

Figure 7:
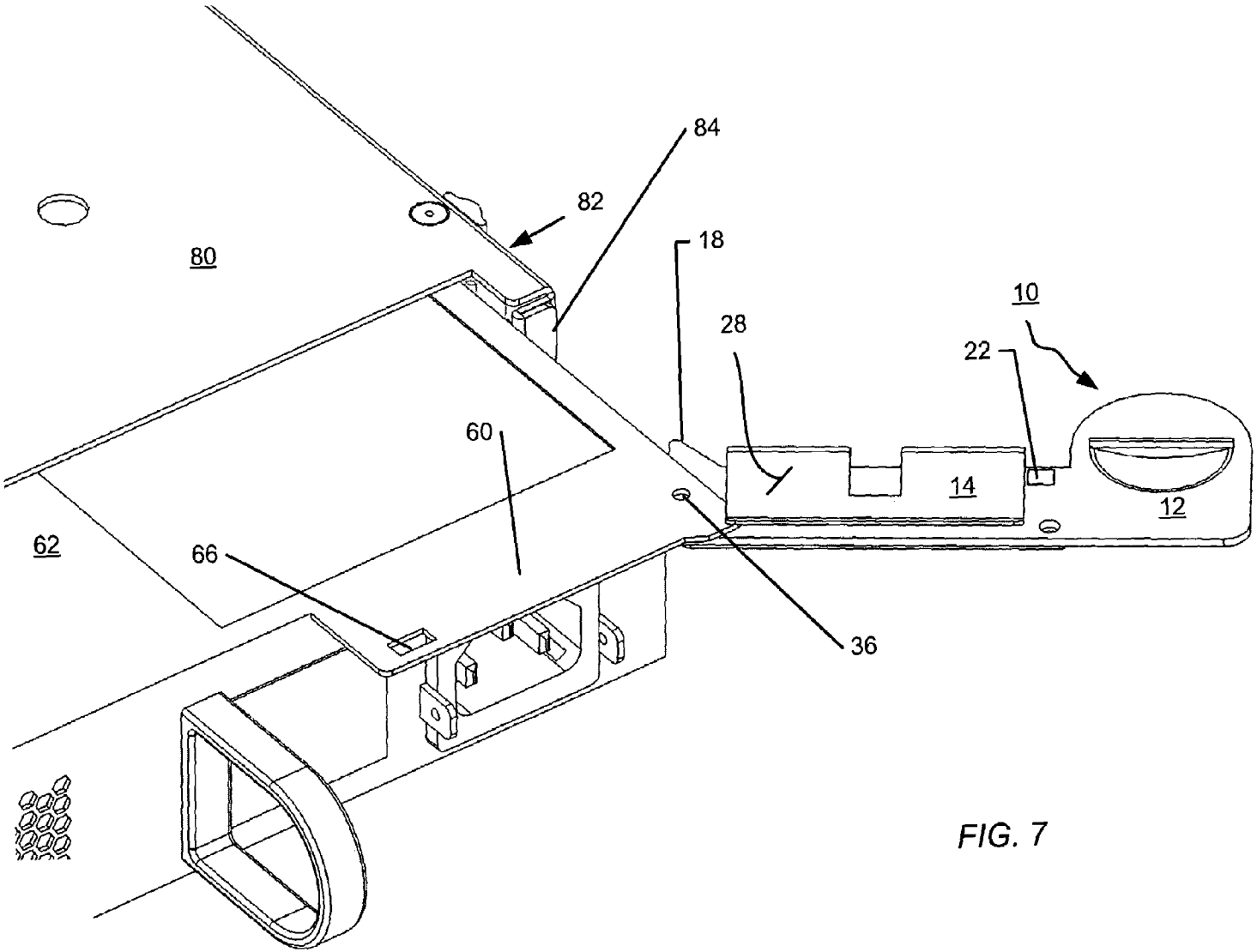
FIG. 7 is an elevated view of the electronics module partially inserted into a chassis, with the lever-and-spring assembly in an open position.
Figure 8:
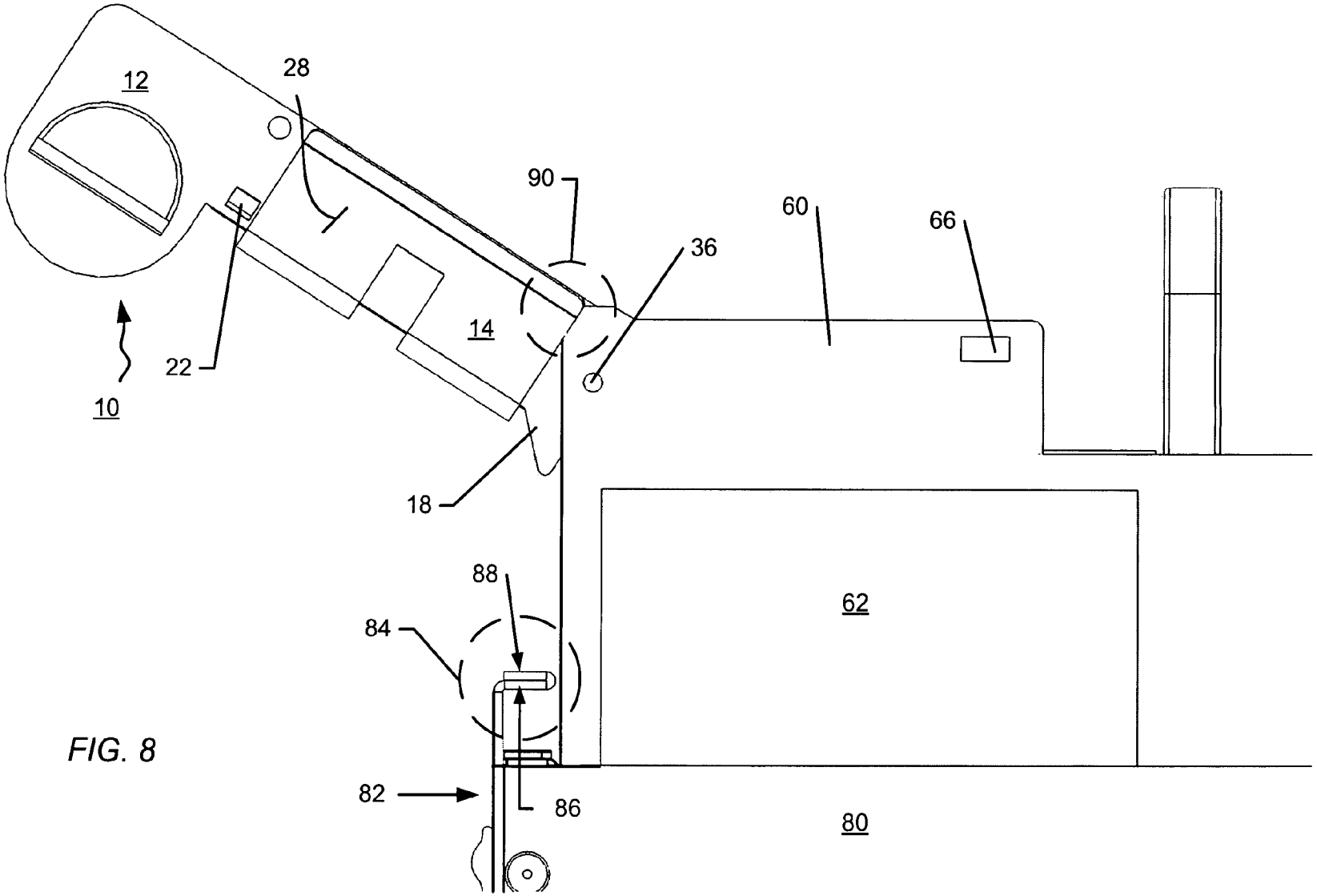
FIG. 8 is a top view of the electronics module partially inserted into the chassis of FIG. 7, with the lever-and-spring assembly in an open position.

FIG. 7 shows the electronics module 62 partially inserted into an enclosure chassis 80, with the lever-and-spring assembly 10 in an open position. The chassis 80 is sized to receive the electronics module 62 closely. The chassis 80 has a sidewall 82 with an external edge 84 (also called a hem bend), which, in general, serves a load-bearing surface against which the lever 12 may press when opening and closing the lever-and-spring assembly 10. Other types of load-bearing surfaces, panels, and walls of a chassis can be used to practice the invention. FIG. 8 shows the external edge 84 from a top view. The external edge 84 bends inwardly, generally orthogonal to the sidewall 82, and has an internally facing surface 86 and an externally facing surface 88. Also shown, the stop prong 18 of the lever 12 limits the extent of counterclockwise rotation of the lever-and-spring assembly 10 by coming up against the side of the electronics module 62. At this fully open position, a portion of the flange 60 (shown within dashed circle 90) remains pinched between the spring portion 28 of the leaf spring 14 and the lever 12.

Figure 9:
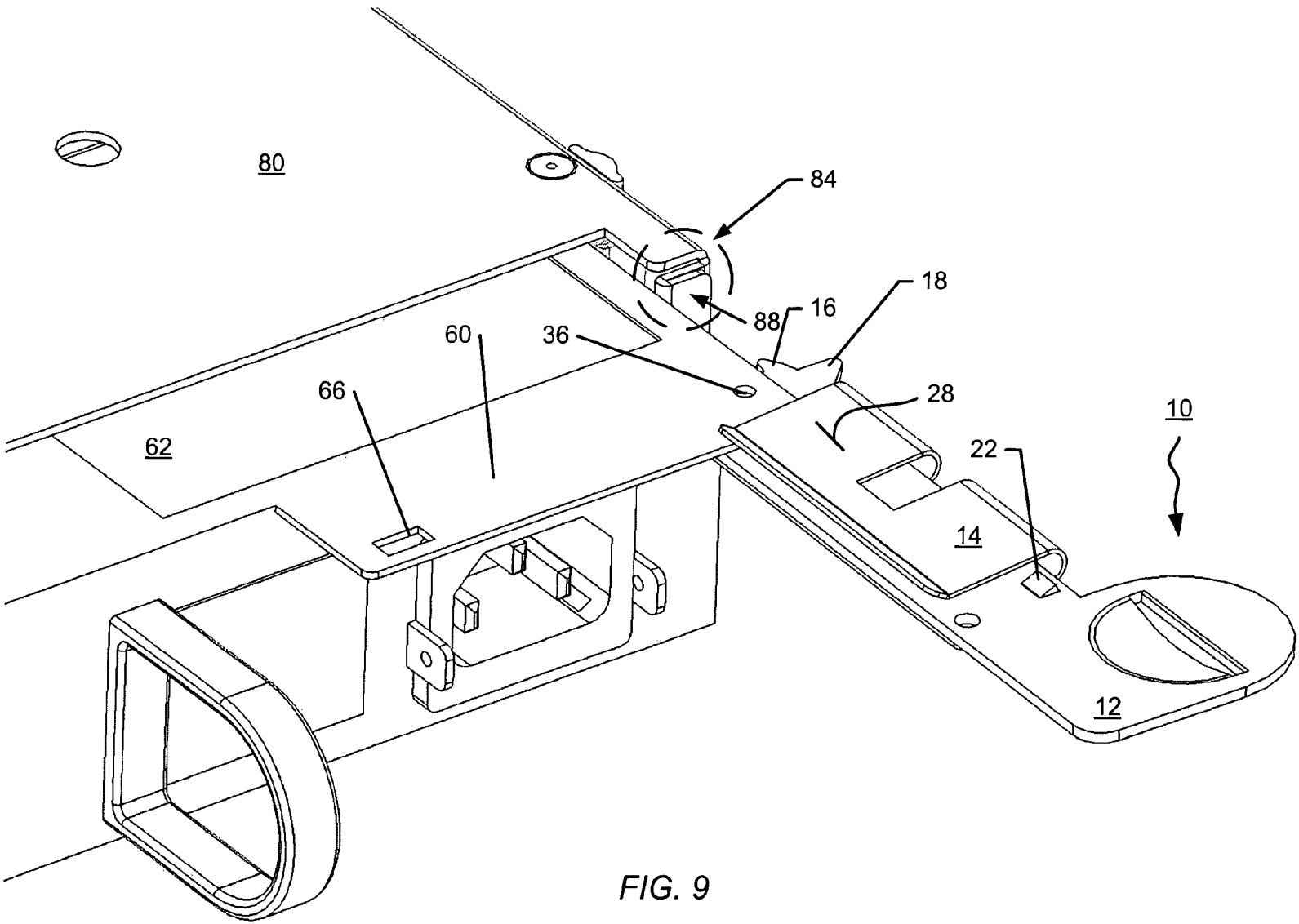
FIG. 9 is an elevated view of the electronics module partially inserted into the chassis of FIG. 7, with the lever-and-spring assembly in an intermediate open position.
Figure 10:
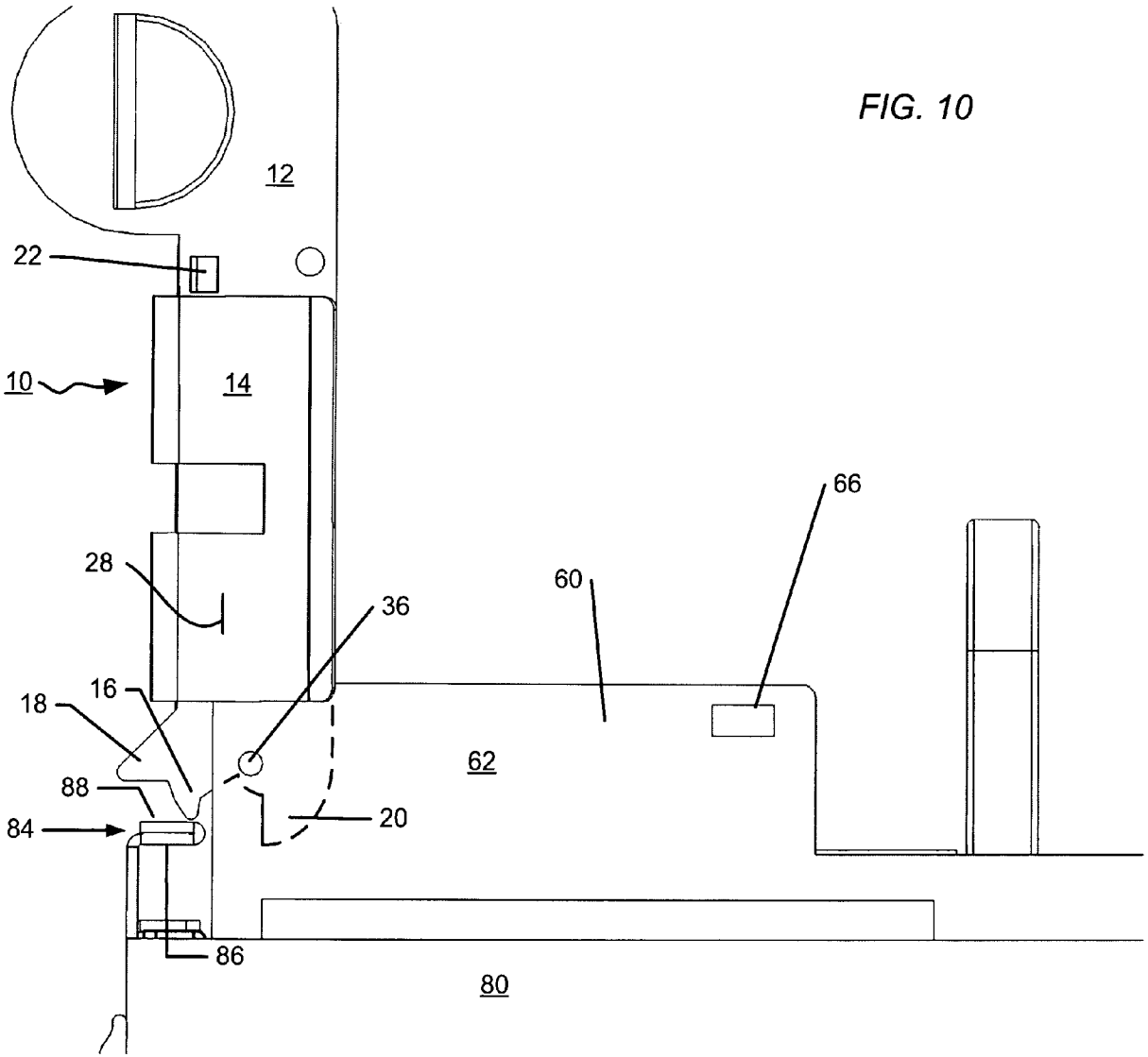
FIG. 10 is an elevated view of the electronics module partially inserted into the chassis of FIG. 7, with the lever-and-spring assembly in the intermediate open position of FIG. 9.

FIG. 9 shows the electronics module 62 partially inserted into the chassis 80, with the lever-and-spring assembly 10 in an intermediate open position. The positioning of the extraction prong 16 causes the extraction prong 16 to make contact with the externally facing surface 88 of the external edge 84 when the electronics module 62 is inserted farther into the chassis 80. As shown in FIG. 10, after the extraction prong 16 touches the externally facing surface 88, and the lever-and-spring assembly 10 is in position to pivot the insertion prong 20 behind the internally facing surface 86 of the external edge 84.

Figure 11:
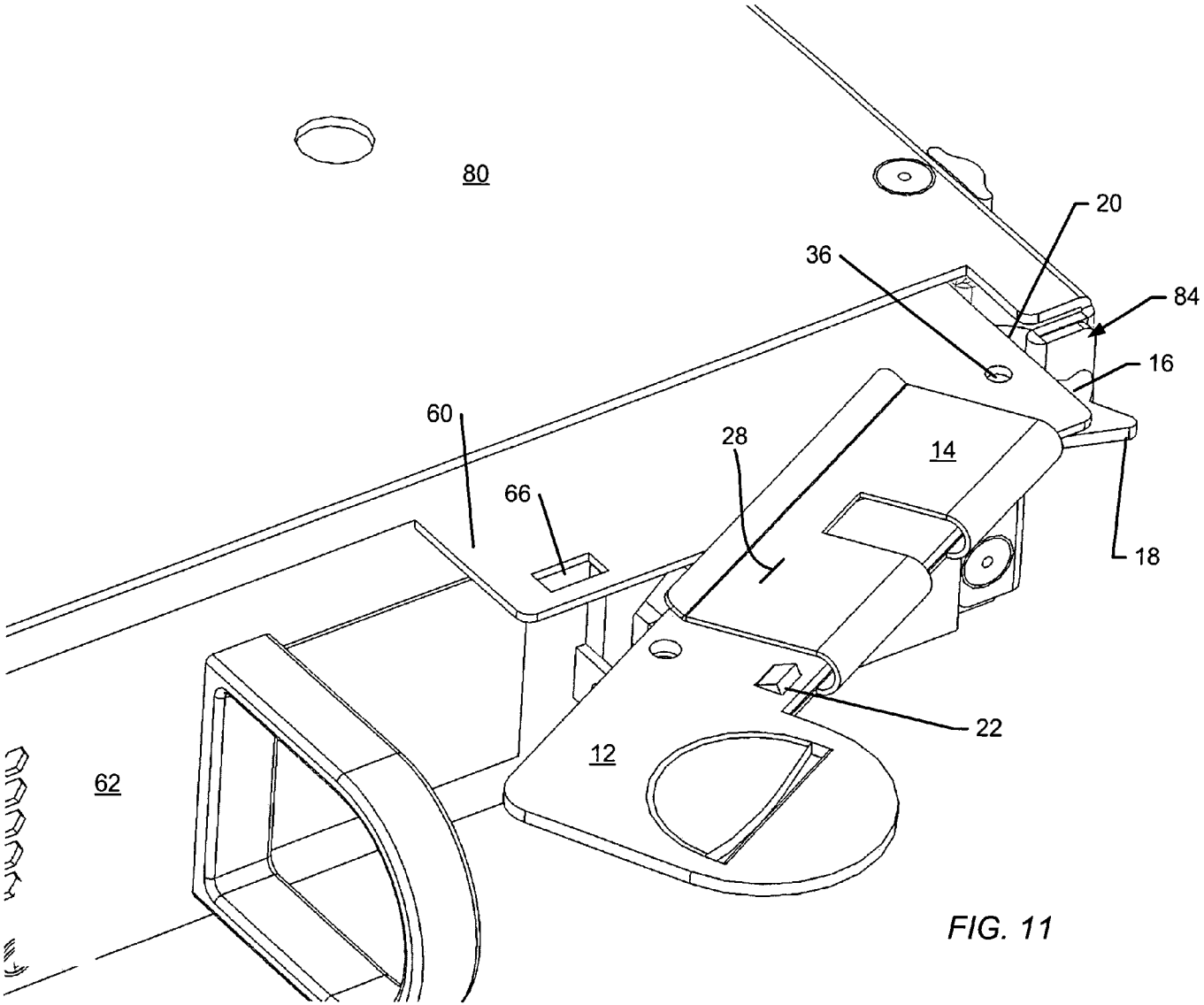
FIG. 11 is an elevated view of the electronics module almost fully inserted into the chassis of FIG. 7, with the lever-and-spring assembly in a partially closed position.
Figure 12:
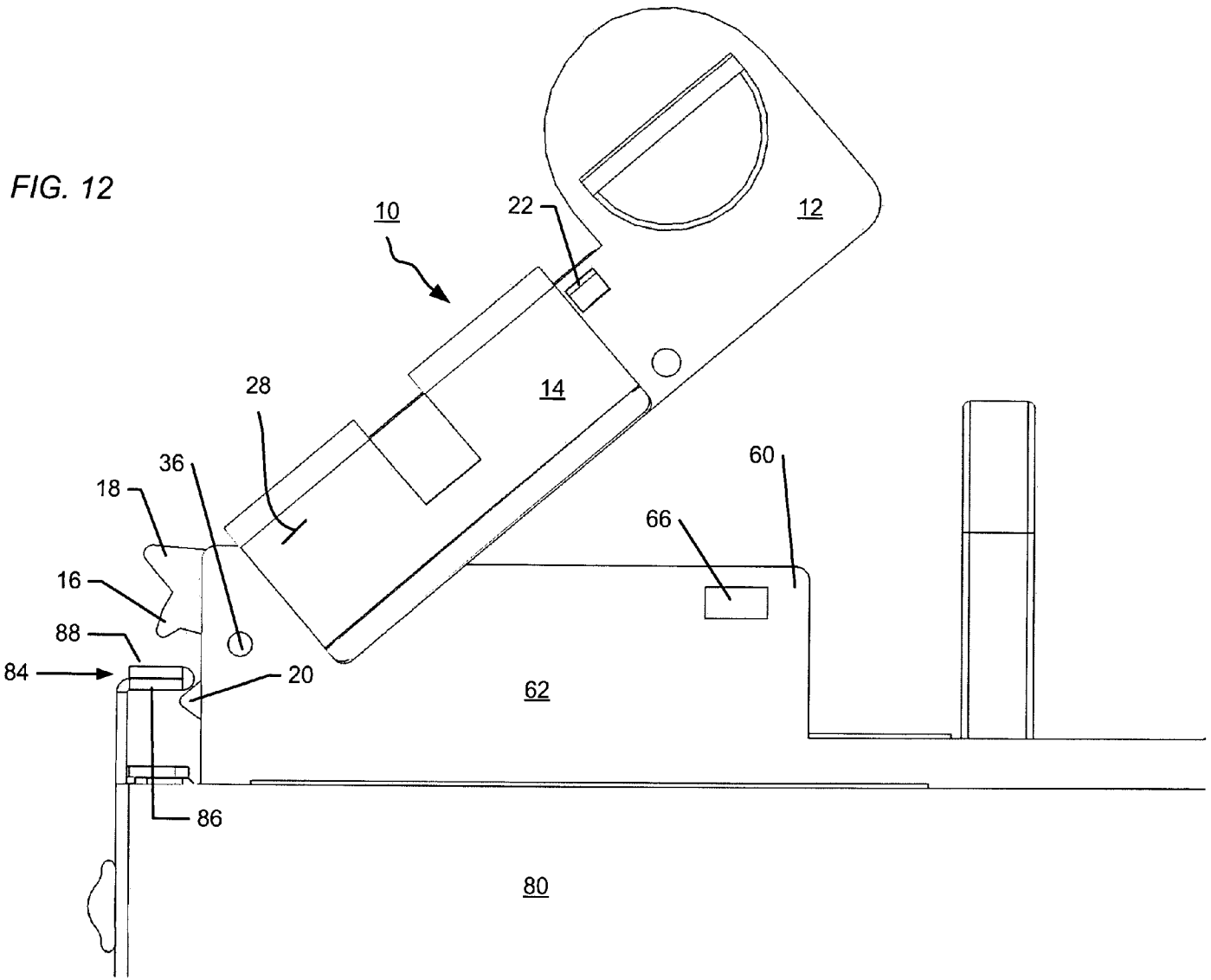
FIG. 12 is a top view of the electronics module almost fully inserted into the chassis of FIG. 7, with the lever-and-spring assembly in a partially closed position.

FIG. 11 and FIG. 12 show the electronics module 62 almost fully inserted into the chassis 80, with the lever-and-spring assembly 10 in a partially closed position. Pivoting the lever-and-spring assembly 10 in a clockwise direction causes the insertion prong 20 to push outwardly against the internally facing surface 86. This force against the internally facing surface 86 draws the electronics module 62 farther into the chassis 80, e.g., to make an electrical connection between an electrical connector (not shown) at the far side of the electronics module 62 and an electrical connector (not shown) within the chassis 80).

Figure 13:
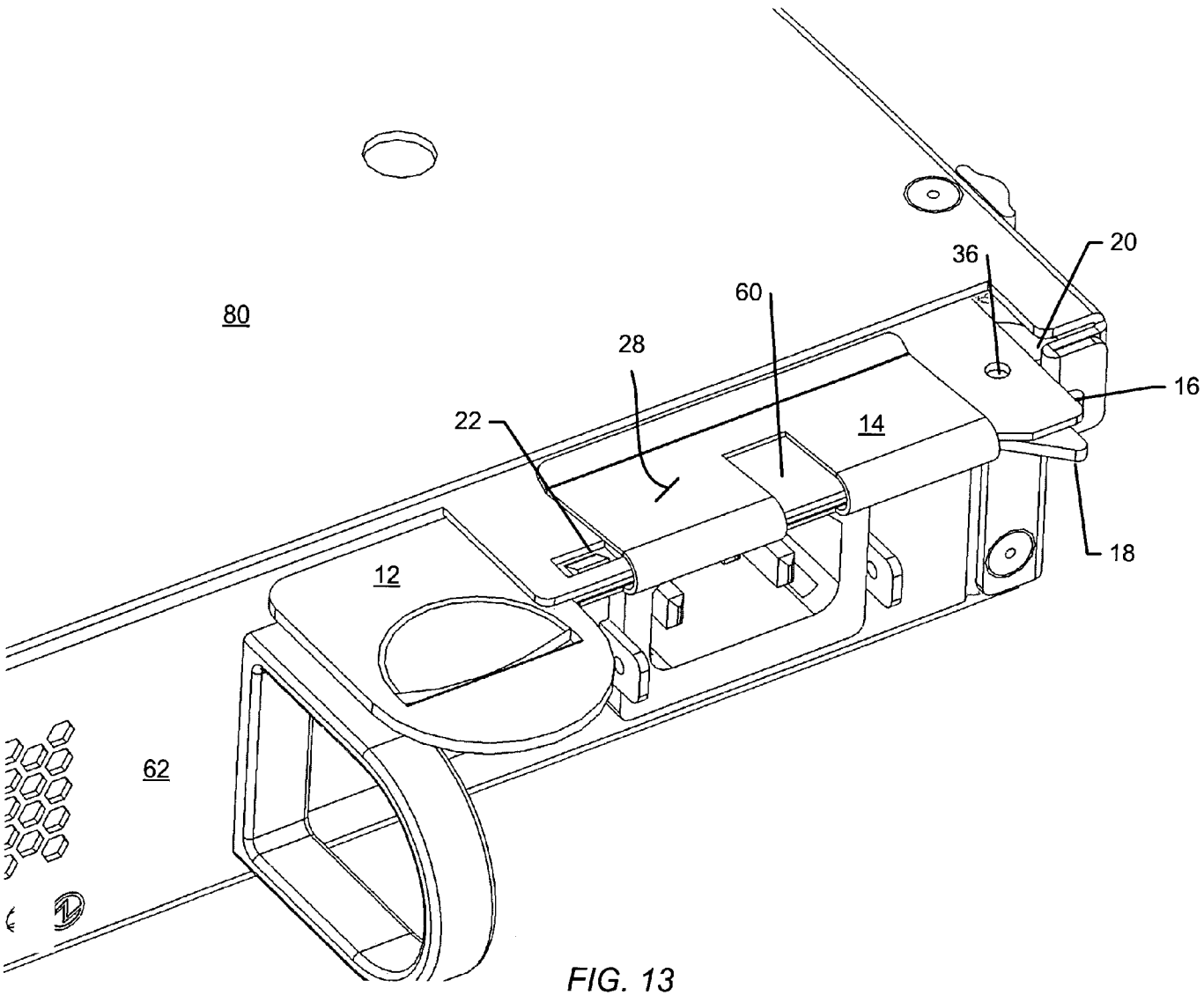
FIG. 13 is an elevated view of the electronics module fully inserted into the chassis of FIG. 7, with the lever-and-spring assembly in a closed position.
Figure 14:
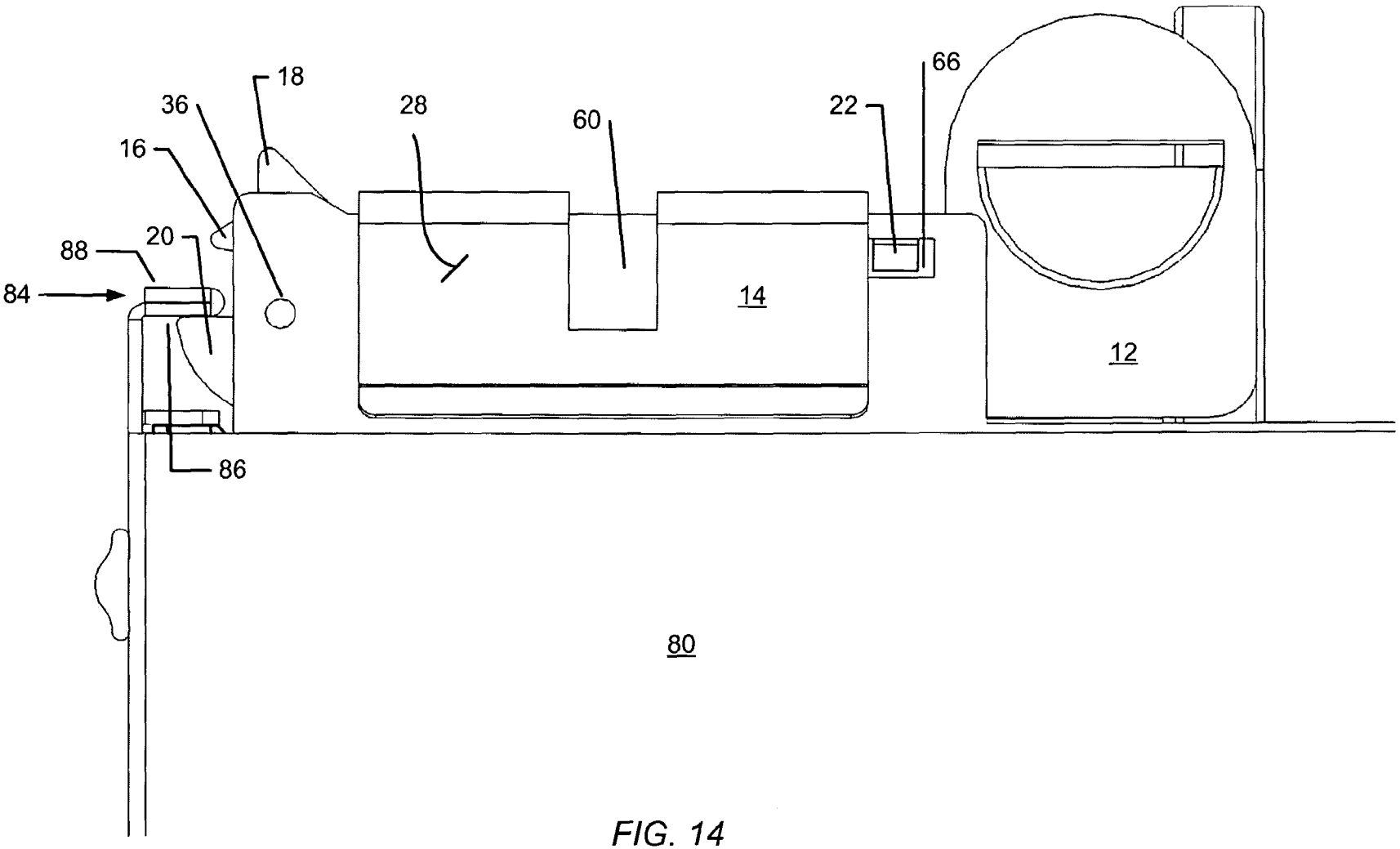
FIG. 14 is a top view of the electronics module fully inserted into the chassis of FIG. 7, with the lever-and-spring assembly in the closed position.

FIG. 13 and FIG. 14 show the electronics module 62 fully inserted into the chassis 80, with the lever-and-spring assembly 10 in a fully closed position. In this fully closed position, the electronics module 62 is secure within the chassis 80: the catch 22 is disposed within the detent 66 of the flange 60; the flange 60 lies pressed between the spring portion 28 and the lever 12; and the insertion prong 20 sits tightly flushed against the internally facing surface 86.

To extract the electronics module 62 from the chassis 80, a user presses down upon the dimple portion 24 of the lever 12 to disengage the catch 22 from the detent 66. While the catch 22 is thus disengaged, the user pivots the lever-and-spring assembly 10 in a counterclockwise motion, pulling on an edge of the dimple 24 with a fingertip. The counterclockwise motion rotates the insertion prong 20 away from the internally facing wall 86 of the external edge 84 and rotates the extraction prong 16 towards the externally facing wall 88. Additional counterclockwise pivoting causes the extraction prong 16 to contact and push against the externally facing wall 88, thereby urging the electronics module 62 out of the chassis 80.

While the invention has been shown and described with reference to specific preferred embodiments, it should be understood by those skilled in the art that various changes in form and detail may be made therein without departing from the spirit and scope of the invention as defined by the following claims. For example, a mechanism described above for latching the lever-and-spring assembly to the flange includes a catch and a detent. In the embodiments described, the catch is on a surface of the lever, and the detent is formed in the flange. In an alternative embodiment, the lever has the detent and the flange has the catch.

What is claimed is:

1. An electronics module, comprising:

a housing with a plurality of sides;

a flange extending from an edge of one of the sides of the housing; and a lever-and-spring assembly having a lever coupled to the flange at a pivot point about which the lever-and-spring assembly can pivot, and a leaf spring with a base portion and a spring portion extending from an edge of the base portion and bending back over the base portion, the lever being disposed between the base portion and the spring portion, the base portion being affixed to the lever, the spring portion bending back over the lever, the flange sliding closely between the spring portion and the lever when the lever-and-spring assembly pivots towards a closed position.

2. The electronics module of claim 1, wherein the flange has a detent and the lever has a surface and a catch projecting from the surface, the catch entering the detent when the flange slides into the gap between the spring portion and the lever, thereby latching the lever-and-spring assembly to the flange.

3. The electronics module of claim 1, wherein the housing houses a 2U power supply.

4. The electronic module of claim 2, wherein the lever has a surface with a dimple formed therein, the dimple having an edge against which a force can be applied to push on the lever and disengage the catch from the detent of the flange and to pull on the lever to pivot the lever-and-spring assembly into an open position.

5. The electronics module of claim 1, wherein an underside of the spring portion of the leaf spring applies a force against the flange when the lever-and-spring assembly is in the closed position.

6. The electronics module of claim 1, wherein a portion of the flange is disposed in the gap between the spring portion of the leaf spring and the lever for as far as the lever-and-spring assembly is able to pivot about the pivot point.

7. The electronics module of claim 1, wherein the lever has a stop prong projecting from the end of the lever near the pivot point to restrict the extent to which the lever-and-spring assembly is able to pivot about the pivot point.

8. An electronics rack, comprising:

a chassis mounted to the rack; and an electronics module installed in the chassis, the electronics module comprising:

a housing with a plurality of sides;

a flange extending from an edge of one of the sides of the housing; and a lever-and-spring assembly having a lever coupled to the flange at a pivot point about which the lever-and-spring assembly can pivot, and a leaf spring with a base portion and a spring portion extending from an edge of the base portion and bending back over the base portion, the lever being disposed between the base portion and the spring portion, the base portion being affixed to the lever, the spring portion bending back over the lever, the flange sliding closely between the spring portion and the lever when the lever-and-spring assembly pivots towards a closed position.

9. The electronics rack of claim 8, wherein the flange has a detent and the lever has a surface and a catch projecting from the surface, the catch entering the detent to latch the lever-and-spring assembly to the flange when the lever-and-spring assembly pivots into the closed position.

10. The electronics rack of claim 8, wherein the enclosure module houses a 2U power supply.

11. The electronics rack of claim 9, wherein the lever has a surface with a dimple formed therein, the dimple having an edge against which a force can be applied to push on the lever and disengage the catch from the detent of the flange and to pull on the lever to pivot the lever-and-spring assembly into an open position.

12. The electronics rack of claim 8, wherein an underside of the spring portion of the leaf spring applies a force against the flange when the lever-and-spring assembly is in the closed position.

13. The electronics rack of claim 8, wherein a portion of the flange is disposed in the gap between the spring portion of the leaf spring and the lever for as far as the lever-and-spring assembly is able to pivot about the pivot point.

14. The electronics rack of claim 8, wherein the lever has a stop prong projecting from the end of the lever at the pivot point to restrict the extent to which the lever-and-spring assembly is able to pivot about the pivot point.

15. The electronics rack of claim 8, wherein the lever has an insertion prong at the end of the lever near the pivot point, and the chassis has a load-bearing panel with an internal facing surface, the insertion prong of the lever pressing against the internal facing surface of the load-bearing panel as the lever-and-spring assembly pivots into the closed position, to urge the enclosure module into the chassis.

16. The electronics module of claim 15, wherein the lever further comprises an ejection prong extending from the end of the lever near the pivot point, the ejection prong of the lever pressing against an external facing surface of the load-bearing panel as the lever-and-spring assembly pivots out of the closed position, to urge the enclosure module out of the chassis.

* * * * *